United States Patent [19]

Wiese

[11] Patent Number: 4,918,896

[45] Date of Patent: Apr. 24, 1990

[54] TELESCOPIC FLAGPOLE

[76] Inventor: Harold Wiese, North Highland, P.O. Box 236, Madison, S. Dak. 57042

[21] Appl. No.: 258,802

[22] Filed: Oct. 17, 1988

[51] Int. Cl.[5] ..... E04H 12/32

[52] U.S. Cl. ..... 52/632

[58] Field of Search ..... 52/111, 121, 632, 118; 116/173; 248/125, 408, 188.5

[56] References Cited

U.S. PATENT DOCUMENTS

| | | | |
|---|---|---|---|
| 859,233 | 7/1907 | Lane | 52/111 |
| 1,264,063 | 5/1918 | Guichard | 52/111 X |
| 1,482,036 | 1/1924 | Schablow | 116/173 |
| 1,804,293 | 5/1931 | Warzoha | 116/173 |
| 2,711,918 | 6/1955 | Benson | 52/632 |
| 3,103,375 | 9/1963 | McMullin | 248/188.5 X |
| 4,062,156 | 12/1977 | Roth | 52/111 |
| 4,406,097 | 9/1983 | Meston | 52/118 |
| 4,513,938 | 5/1985 | Seymour | 52/632 X |

FOREIGN PATENT DOCUMENTS

| | | | |
|---|---|---|---|
| 364167 | 11/1922 | Fed. Rep. of Germany | 52/632 |
| 3434517 | 3/1986 | Fed. Rep. of Germany | 52/118 |
| 2575780 | 7/1986 | France | 52/118 |
| 513091 | 10/1939 | United Kingdom | 52/632 |
| 1592492 | 7/1981 | United Kingdom | 52/118 |

OTHER PUBLICATIONS

Concord Advertisement Sweets Catalog, 10.28, 1985.

*Primary Examiner*—David A. Scherbel
*Assistant Examiner*—Jerrold D. Johnson
*Attorney, Agent, or Firm*—Burd, Bartz & Gutenkauf

[57] ABSTRACT

A telescopic flagpole for displaying a flag of banner in its extended position. The flagpole is capable of being retracted telescopically for easy installation and removal of the flag or banner. The retracted flagpole may be temporarily installed in a ground socket for use and removed for storage. The flagpole is composed of at least three rigid elongated cylindrical tubular segments having guide means to facilitate telescopic movement, stop means to limit extension of the tubular segments, and locking means for securing the segments in extended position. Means are provided for holding flags or banners of varying sizes free of twisting and entanglement around the flagpole.

9 Claims, 3 Drawing Sheets

TELESCOPIC FLAGPOLE

BACKGROUND OF THE INVENTION

1. FIELD OF THE INVENTION

This invention is directed to a telescopic flagpole which may be extended to elevate a flag for normal display purposes, but may be telescoped into a shorter compact easy-to-handle structure for carrying, storage, shipping, and the like.

2. THE PRIOR ART

Most present flagpoles are rigid unitary structures, normally about 15 to 25 feet tall or more, intended to be permanently installed at an appropriate location such as a school yard, veterans' organization post, residence yard, and the like. To hoist the flag, a pulley is ordinarily provided at the top of the flagpole. A lanyard with snap hooks to engage grommets on the edge of the flag extends from that pulley to line gripping means within easy reach from ground level. Replacement of the lanyard is difficult if it breaks or wears out as a result of age and constant exposure to varying weather conditions. One means of facilitating easier attachment of a flag to the top of a flagpole is to provide a pivot joint at about waist level or lower, permitting the end of the flagpole to be lowered to just above ground level. This, however, involves a bulkier more complex base structure. Flags are subject to whipping wind damage. Flags often become wrapped around the flagpole and entangled. Permanently installed flagpoles are subject to weathering, sometimes requiring difficult repainting. They are subject to vandalism, and the like. The flagpole of the present invention is designed to overcome some of these problems and inconveniences.

SUMMARY OF THE INVENTION

Broadly stated, the flagpole of the present invention comprises a plurality of at least three telescoping cylindrical tubular segments. The bottommost segment of greatest diameter is adapted to be received with a slide fit in a cylindrical ground socket. The topmost segment is fitted with flag-engaging means. Guide means are provided to facilitate extension and retraction of the tubular flagpole segments. Retaining means are provided to prevent separation of the telescoped segments when in retracted position. Stop means are provided to limit maximum extension of the tubular segments. Locking means are provided to lock the tubular flagpole segments in place at their maximum extension for normal use of the flagpole.

BRIEF DESCRIPTION OF THE DRAWINGS

The invention is illustrated by the accompanying drawings in which corresponding parts are identified by the same numerals and in which.

DETAILED DESCRIPTION OF THE PREFERRED EMBODIMENT

Figure 1:
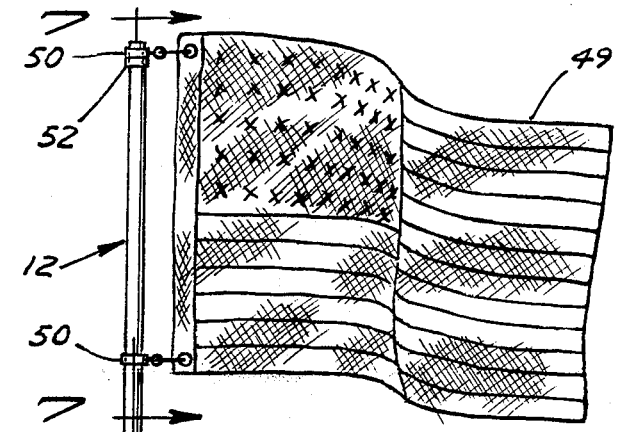
FIG. 1 an elevation, partly in section at ground level, showing the telescopic flagpole of the present invention in fully extended position for normal use.
Figure 4:
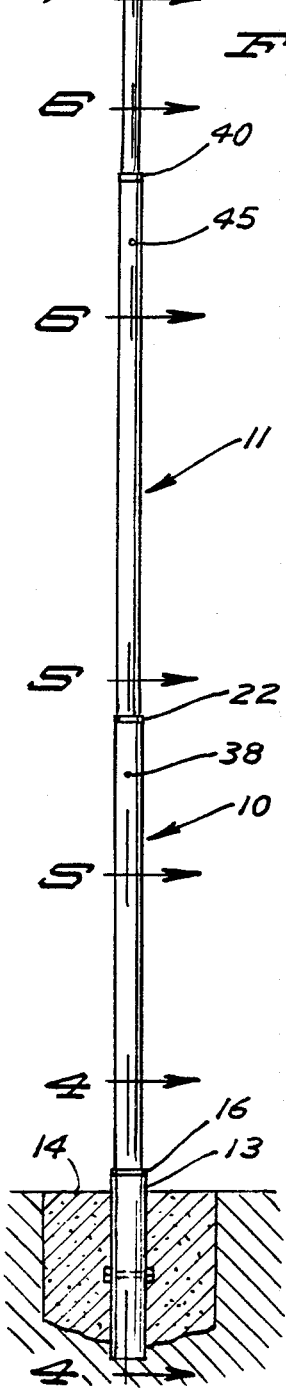
FIG. 4 is an enlarged section of the flagpole socket showing the bottommost segment of the flagpole installed therein.
Figure 4:
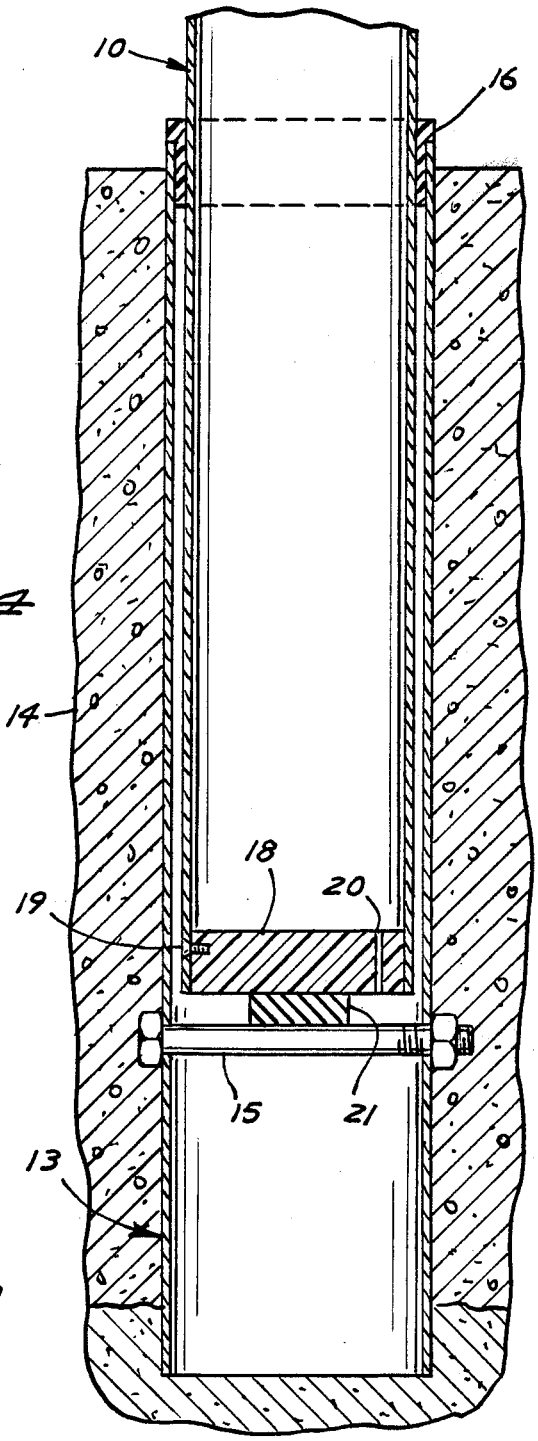
Figure 2:
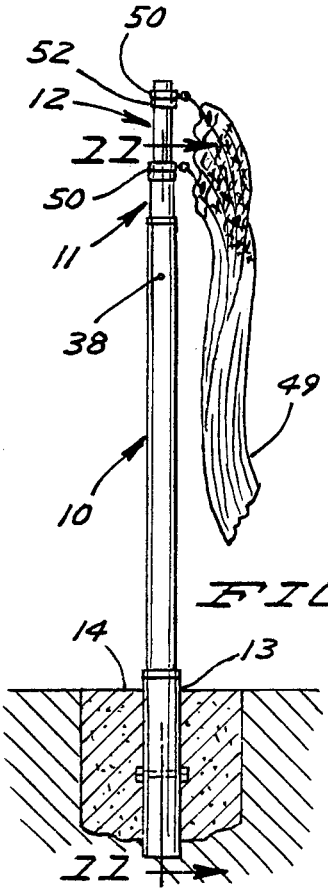
FIG. 2 is a similar elevation showing the flagpole in its retracted state for placement or removal of a flag from the flagpole.
Figure 3:
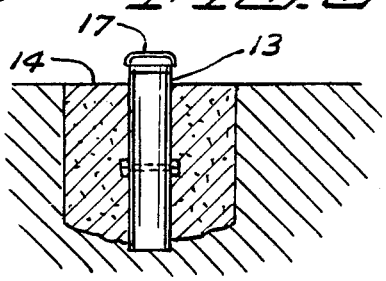
FIG. 3 is an elevation partly in section of a ground installed socket for holding the flagpole.
Figure 5:
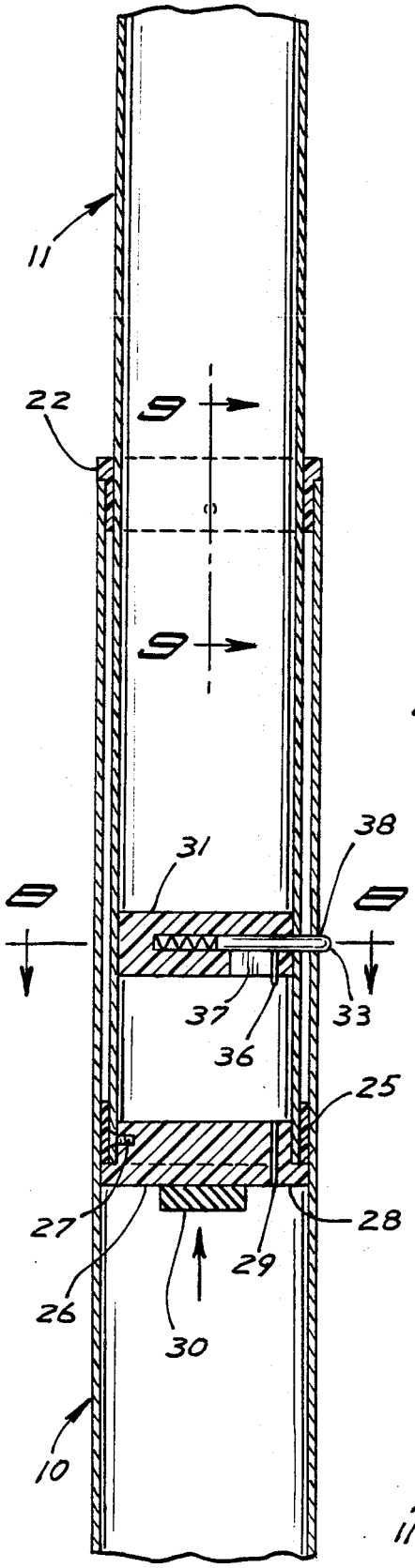
FIG. 5 is a section on the line 5—5 of FIG. 1 and in the direction of the arrows.
Figure 6:
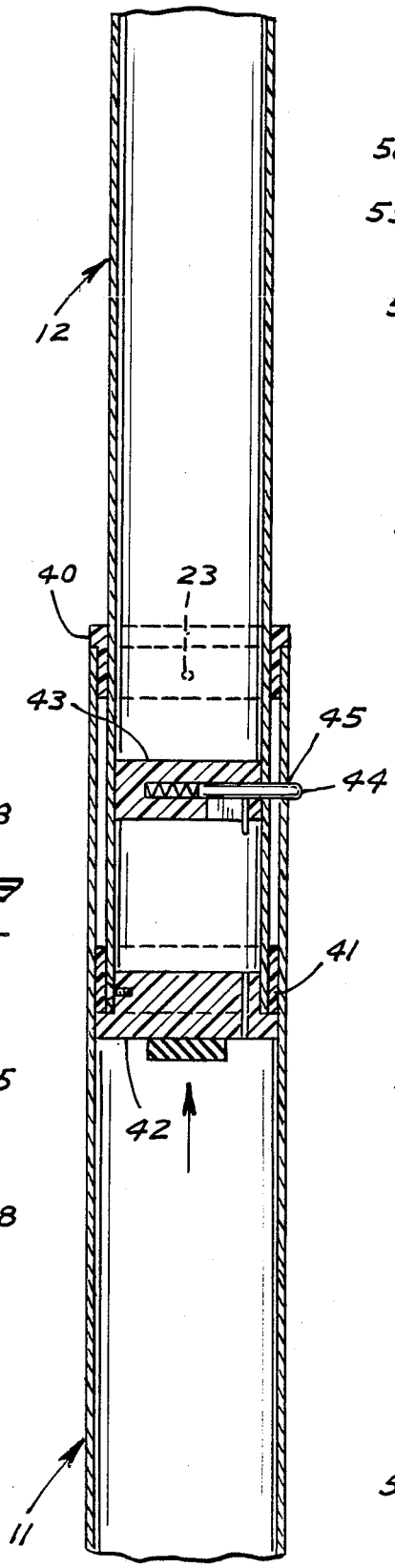
FIG. 6 is a section on the line 6—6 of FIG. 1 and in the direction of the arrows.
Figure 7:
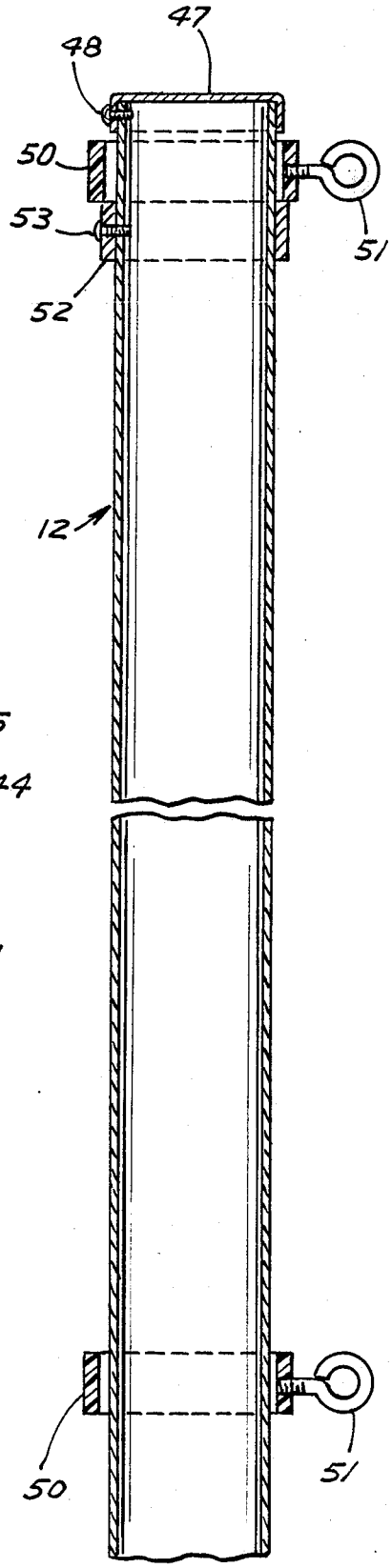
FIG. 7 is a section on the line 7—7 of FIG. 1 and in the direction of the arrows.

Referring now to the drawings, and particularly to FIG. 1, there is shown a telescopic flagpole according to the present invention shown installed for ordinary use. The flagpole is comprised of a plurality of elongated cylindrical tubular telescoping segments including a bottom segment 10, at least one intermediate segment 11, and a top segment 12. The bottommost end of bottom flagpole segment 10 fits with a close slide fit into cylindrical tubular socket 13 which is encased in a concrete or asphaltic plug or collar 14 set into the ground. Socket 13 extends beyond the depth of plug 14 and is open at the bottom for drainage. Stop means, such as a cross bolt 15, are provided to support the flagpole at a fixed position above the bottommost end of the socket. A flanged guide ring or collar 16 is desirably positioned in the top end of socket 13. When the flagpole is not in place in the socket, the top open end of socket 13 is provided with a plug or cap 17 to prevent the accumulation of moisture and debris.

Figure 9:
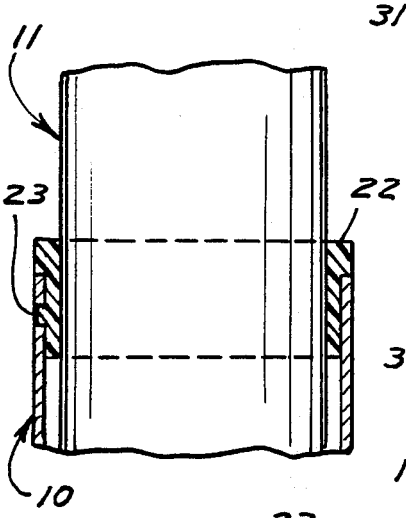
FIG. 9 is a section on the line 9—9 of FIG. 5 and in the direction of the arrows.
Figure 10:
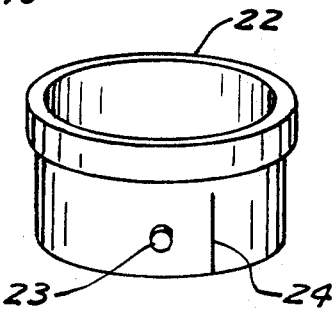
FIG. 10 is a perspective view of a tubular guide member for the telescopic segments.
Figure 11:
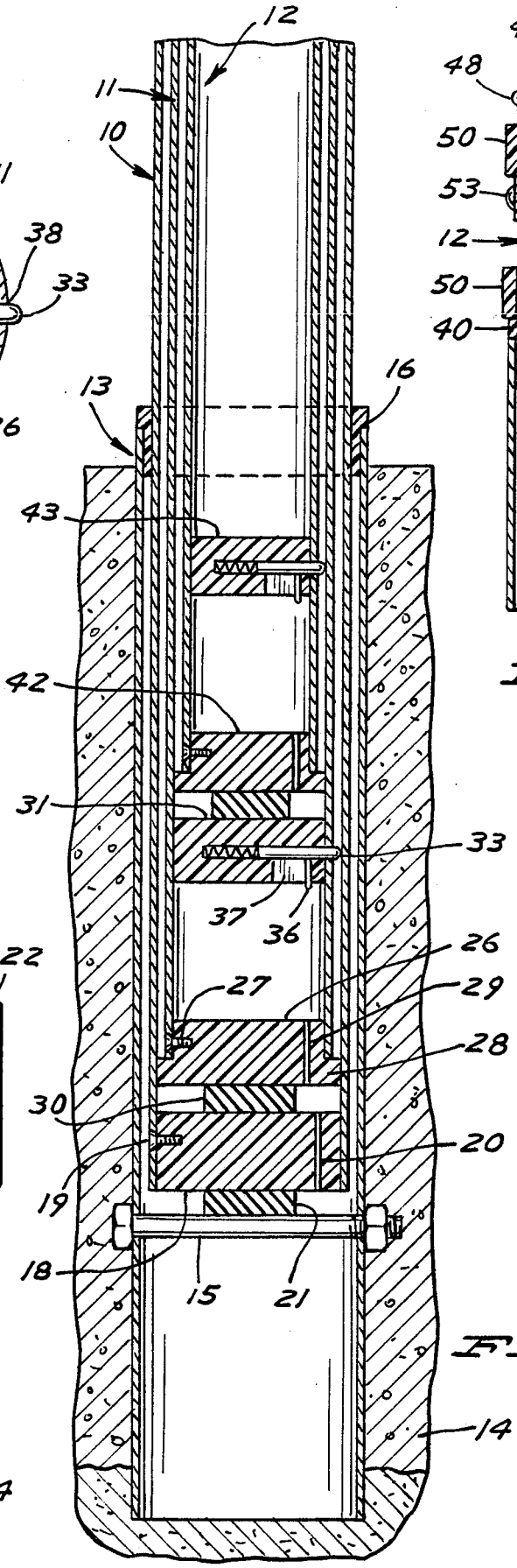
FIG. 11 is a vertical section generally on the line 11—11 of FIG. 2 and in the direction of the arrows showing the bottommost portions of the flagpole segments in retracted position.
Figure 12:
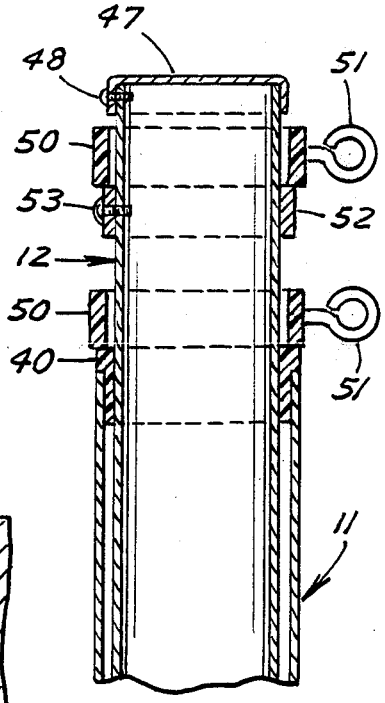
FIG. 12 is a similar section of the topmost end of the flagpole.

The lowermost end of bottom flagpole segment 10 is provided with a plug closure 18 held in place by screw 19, for example. A drain hole 20 is preferably provided to act as an air bleed hole when the segments are retracted and to permit release of any accumulated condensed moisture within the tubular segment. Desirably a resilient bumper pad 21 is provided on the outside surface of plug 18 to cushion the flagpole when inserted in socket 13 against stop bolt 15. The topmost end of flagpole segment 10 is provided with a flanged guide ring or collar 22, which functions as a bushing for intermediate flagpole segment 11. The flanged shoulder of guide ring 22 engages the top end of tubular segment 10. If desired, the outer end of guide ring 22 may be tapered by beveling or champfering. As best seen in FIGS. 9 and 10, the guide ring 22 may be locked in place by means of a small bump or similar projection 23 which engages a hole in the end of segment 10. To provide some resiliency to facilitate installation of the guide ring, a narrow slot or slit 24 is provided in the wall adjacent to projection 23.

An internal stop ring 25 is fixed to the inside wall of tubular segment 10 spaced downwardly from the top end thereof. As explained in greater detail hereinafter, stop ring 25 functions to limit outward extension of intermediate tubular segment 11 and serves as a guide ring and bushing for that segment.

Intermediate tubular flagpole segment 11 is of a diameter adapted to fit telescopically with a close slide fit within the bushings of guide ring 22 and stop ring 25 of bottom segment 10. The bottommost end of intermediate segment 11 is provided with a flanged plug 26 held in place as by means of screw 27, for example. The outer periphery of the flanged shoulder 28 of plug 26 engages the inside wall of tubular segment 10 to guide telescopic movement of intermediate segment 11 therein. The top edge of shoulder 28 engages the bottom edge of stop ring 25 to limit outward extension of intermediate segment 11. A drain hole 29 is preferably provided in plug 26 to permit drainage of any accumulated condensation. A resilient bumper pad 30 is preferably provided on the bottom surface of plug 26 to cushion contact between plugs 26 and 18 when the flagpole is retracted.

Figure 8:
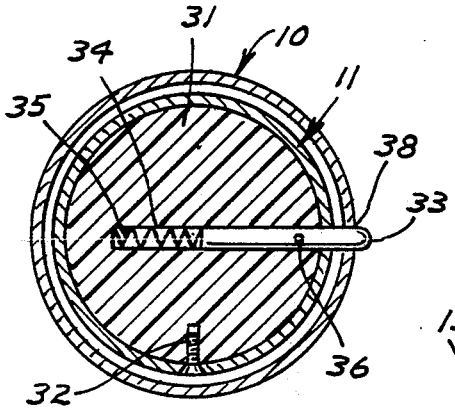
FIG. 8 is a section on the line 8—8 of FIG. 5 and in the direction of the arrows.

Intermediate segment 11 is locked in place at its maximum extension when shoulder 28 engages stop ring 25. As best seen in FIG. 8, the locking means comprises an annular plug 31 fixedly secured within intermediate tube 11 as by means of screw 32, for example. A spring biased radial pin 33 is positioned in a horizontal circular cross section passage 34 within plug 31. Coil spring 35 within passage 34 urges pin 23 outwardly. Movement of pin 33 is limited by stop pin 36 extending downwardly from pin 33 and engaging radial slot 37 in plug 31 and in communication with passage 34. The outer end of locking pin 33 is rounded. It engages and extends through locking hole 38 in bottom segment 10. If pin 33 and hole 38 are not in alignment, the intermediate segment 11 is simply rotated manually until the pin and hole are in alignment and the pin snaps outwardly through the hole pushed by coil spring 35.

A guide ring or collar 40 at the top end of intermediate segment 11 functions as a bushing for top flagpole segment 12. Guide ring 40 in all material respects is identical to guide ring 22 already described, except for its lesser diameter adapting it to fit into intermediate segment 11 and receive top segment 12. An internal stop ring 41 is provided in intermediate segment 11 spaced downwardly from guide ring 40 and adapted to limit outward extension of top segment 12. When two or more intermediate segments are required in order to produce a flagpole of the desired height, the additional intermediate segments are in all material respects identical to those of segment 11, except for reduced diameters permitting telescopic assembly and operation.

Top flagpole segment 12 is of diameter to fit with a close slide fit within guide ring 40 of the topmost intermediate segment. The bottom end of top segment 12 is provided with a plug 42 which is in all material respects identical to plug 26 at the bottom end of intermediate segment 11, except for its reduced diameter. The outer periphery of the flange of plug 42 engages the inside wall of intermediate segment 11 and functions to guide and stabilize the top segment. The shoulder of the flange of plug 42 engages stop ring 41 to limit upward extension of top segment 12 and to position the locking means for locking engagement with intermediate segment 11. Plug 43 enclosing the locking means for the top segment is spaced above bottom plug 42 and in all material respects, except for reduced diameter, is identical to the locking means already described in connection with intermediate tube 11. Locking pin 44 engages locking hole 45 in intermediate segment 11 spaced downwardly from the top end thereof in the same manner as the intermediate segment is locked to the bottom segment.

The top end of top segment 12 is closed by means of a cap 47 fixedly secured as by means of screw 48, for example. Alternatively, an ornamental top closure may be provided, such as an eagle, sphere, cross, or the like. A flag or banner 49 is attached to the flagpole by means of a pair of flag-engaging rings 50 of identical structure. Each of rings 50 is provided with a fixed eye 51 adapted to receive a conventional snap fastener which in turn is adapted to engage a grommet in the edge of the flag or banner. Both flag-engaging rings 50 have an internal diameter greater than the outside diameter of top segment 12. In this manner, the flag-engaging rings are freely rotatable about the flagpole so as to prevent the flag from becoming entangled and wrapped around the flagpole.

The top flag-engaging ring 50 is maintained in place adjacent the top end of segment 12 by means of a fixed external stop ring 52 held in place, for example, by means of screw 53. The bottom flag-engaging ring 50 is freely slidable along top segment 12 between stop ring 52 and the top of intermediate segment 11. Because of this, the flagpole can accommodate flags and banners of varying widths. If the flag or banner to be flown is provided with more than two grommets, additional flag-engaging rings may be added as necessary. As is apparent, the need for a lanyard is eliminated, along with the whipping wind damage, wrapping and entanglement, and need for replacement, which use of a lanyard entails.

The telescopic flagpole according to the present invention is easily assembled. Starting with the top segment 12, the plugs 43 and 42 are fastened in place. The top segment is inserted into the bottom end of the intermediate segment already fitted with its guide ring 40 and stop ring 41. When the top end of segment 12 projects through the top end of intermediate segment 11, plugs 31 and 26 are set into place and both top segment 12 and intermediate segment 11 are passed through the bottom end of bottom segment 10 already fitted with guide ring 22 and stop ring 25. When the top and intermediate segments extend through the top of bottom segment 10, plug 18 is set in place. The lower flag-engaging ring 50 is put in place on segment 12 followed by stop ring 52, upper flag-engaging ring 50, and top cap 47. The flagpole is now ready for use.

In fully retracted position, the flagpole may be set into ground socket 13. Flag or banner 49 is attached to the snap fasteners carried by rings 50. The top segment 12 is then pulled upwardly until the shoulder of plug 42 engages stop ring 41 in intermediate segment 11. The top segment is rotated until locking pin 44 engages hole 45. Then the procedure is repeated with respect to intermediate segment 11 which is extended until shoulder 28 engages stop ring 25. The intermediate tube is rotated until pin 33 engages hole 38. The flagpole is now extended to its maximum length. When it is desired to remove the flag, the procedure is reversed. Pin 33 is pushed into hole 38 until it is released from its locking position. Then intermediate tube 11 is retracted its full length. The locking means of the top segment is similarly disengaged, and the top segment is retracted. The flag is removed and the retracted flagpole may be removed from the ground socket for storage.

By way of example, the flagpole segments may be made of standard aluminum tubing, preferably hard aircraft aluminum anodized to inhibit corrosion. The outside diameters of adjacent segments preferably vary in $\frac{1}{4}$ inch increments: $1\frac{3}{4}$ inch, 2 inch, $2\frac{1}{4}$ inch, $2\frac{1}{2}$ inch, etc. The overlap between adjacent telescoping segments is preferably on the order of about 1 foot. Thus, to produce a 15 foot flagpole, three 6 foot segments are employed. The earth socket is preferably about 18 inches long and the stop bolt is about 12 inches from the top. The locking pins are located about six inches above the bottom ends of their respective segments; the locking holes are located about six inches below the top ends of their respective segments; and the stop rings are located about 1 foot below the top ends of their respective segments, or six inches below the locking hole. To produce a 20 foot flagpole, an extra 6 foot intermediate section is used, and so on.

The guide rings and stop rings which function as bushings and the flag-engaging swivel rings are desirably formed from polycarbonate synthetic resin. The plugs housing the locking mechanism and enclosing the bottom ends of the tubular segments may be formed from polyethylene, nylon, or the like.

It is apparent that many modifications and variations of this invention as hereinbefore set forth may be made without departing from the spirit and scope thereof. The specific embodiments described are given by way of example only and the invention is limited only by the terms of the appended claims.

I claim:

1. A lanyard free telescoping flagpole comprising:

(A) a bottom segment, at least one intermediate segment, and a top segment, each of said segments comprising a rigid elongated cylindrical tube of a size to fit telescopically within the next adjacent lower tube, (B) guide means to facilitate telescopic movement of adjacent tubes comprising:

(1) bushings adjacent to the upper ends of said bottom and intermediate segments, said bushings being engageable with the outer surfaces of the next adjacent upper tube, and (2) annular shoulders projecting from the lower ends of said intermediate and top segments, said shoulders being engageable with the inner surfaces of the next adjacent lower tube, (C) stop means to limit upward extension of adjacent tubes comprising internal bushing rings spaced downwardly from the bushings of the upper ends of the bottom and intermediate segments, said rings being engageable with the outer surfaces of the next adjacent upper tube and with the projecting shoulders of the next adjacent upper tube, (D) locking means for securing adjacent tubes in extended relation, and (E) flag-engaging means on said top segment.

2. A telescoping flagpole according to claim 1 wherein said locking means comprises a spring biased radial pin extending outwardly through the tube wall of the intermediate and top segments, said pin being engageable in a locking hole in the next adjacent lower tube.

3. A telescoping flagpole according to claim 1 wherein said flag-engaging means comprises at least a pair of swivel rings freely rotatable around the top segment, the uppermost of said swivel rings being confined at the top of the top segment.

4. A lanyard free telescoping flagpole comprising a bottom segment, at least one intermediate segment and a top segment, (A) said bottom segment comprising:

(1) a rigid elongated cylindrical tube, (2) retaining means at the bottom of said tube to prevent separation of the intermediate segments therefrom, (3) guide and stop means within said tube to facilitate telescopic movement of the intermediate segment relative to the bottom segment, and to limit upward extension of the intermediate segment comprising:

(a) a bushing adjacent to the upper end of said bottom segment, said bushing being engageable with the outer surface of the next adjacent intermediate segment, and (b) an internal bushing ring spaced downwardly from the bushing at the upper end of the bottom segment, said ring being engageable with the outer surface of the next adjacent intermediate segment and with a projecting shoulder at the bottom end thereof, and (4) means for locking said segments in extended relation, (B) each of said intermediate segments comprising:

(1) a rigid elongated cylindrical tube of diameter adapted to fit telescopically with a close slide fit within said next adjacent lower segment, (2) retaining means adjacent to the bottom of said tube to prevent separation of the next adjacent upper segment therefrom, (3) guide and stop means within said tube to facilitate telescopic movement of the next adjacent upper segment relative to the intermediate segment, and to limit upward extension of the next adjacent upper segment comprising:

(a) bushings adjacent to the upper ends of each of said intermediate segments, said bushings being engageable with the outer surfaces of the next adjacent upper segment, (b) annular shoulders projecting from the lower ends of said intermediate and top segments, said shoulders being engageable with the inner surfaces of the next adjacent lower segment, and (c) internal bushing rings spaced downwardly from the upper ends of each of the intermediate segments, said rings being engageable with the outer surfaces and projecting shoulders of the next adjacent upper segment, and (4) means for locking said intermediate segment to the next adjacent lower and next adjacent upper segments in extended relation, and (C) said top segment comprising:

(1) a rigid elongated cylindrical tube of diameter adapted to fit telescopically with a closure slide fit within the next adjacent lower segment, (2) a cap closing the top end of said tube, (3) first flag-engaging means at the top end of said tube, (4) second longitudinally movable flag-engaging means below said first flag engaging means, and (5) means for locking said top segment in extended relation to said next adjacent lower segment.

5. A telescoping flagpole according to claim 4, wherein said locking means comprises a spring biased radial pin extending outwardly through the tube wall of the intermediate and top segments, said pin being engageable in a locking hole in the next adjacent lower tube.

6. A telescoping flagpole according to claim 4 wherein said flag engaging means comprises at least a pair of swivel rings freely rotatable around the top segment, the uppermost of said swivel rings being confined at the top of the top segment.

7. A lanyard free telescoping flagpole comprising a bottom segment, at least one intermediate segment and a top segment, (A) said bottom segment comprising:
(1) a rigid elongated cylindrical tube,
(2) a plug at least partially closing the bottommost end of said tube,
(3) an internal cylindrical bushing at the top end of said tube,
(4) an internal cylindrical stop ring and bushing spaced downwardly from said first bushing but adjacent to the top end of said tube, and
(5) a locking hole through said tube wall spaced between said bushings, (B) each of said intermediate segments comprising:
(1) a rigid elongated cylindrical tube of diameter adapted to fit telescopically with a close slide fit within the bushings of the next adjacent lower segment,
(2) a plug at least partially closing the bottommost end of said tube, said plug including a shoulder of diameter adapted to fit with a close slide fit within said next adjacent lower segment and to engage the stop ring therein to limit telescopic extension of the intermediate segment,
(3) locking means comprising a spring biased radial pin extending outwardly through the tube wall and engageable with the locking hole of the next adjacent lower segment, said pin being spaced upwardly from the top edge of said shoulder by the same distance by which said locking hole is spaced from the bottom edge of the locking ring of said next adjacent lower segment,
(4) an internal cylindrical bushing at the top end of said tube,
(5) an internal cylindrical stop ring and bushing spaced downwardly from said first bushing but adjacent to the top end of said tube, and
(6) a locking hole through said tube wall spaced between said bushings, and (C) said top segment comprising:
(1) a rigid elongated cylindrical tube of diameter adapted to fit telescopically with a close slide fit within the bushings of the uppermost of said intermediate segments,
(2) a plug at least partially closing the bottommost end of said tube, said plug including a shoulder of diameter adapted to fit with a close slide fit within said uppermost intermediate segment and to engage the stop ring therein to limit telescopic extension of the top segment,
(3) locking means comprising a spring biased radial pin extending outwardly through the tube wall and engageable with the locking hole of the uppermost intermediate segment, said pin being spaced upwardly from the top edge of said shoulder by the same distance by which said locking hole is spaced from the bottom edge of the locking ring of the uppermost intermediate segment,
(4) a closure at the top end of said tube,
(5) a first freely rotatable swivel ring having flag-engaging means extending around said top tube adjacent the top end thereof,
(6) an external stop ring secured to said top tube below said first rotatable ring, and
(7) a second freely rotatable and longitudinally movable swivel ring having ring engaging means extending around said top tube below said stop ring.

8. A telescoping flagpole according to claim 7 wherein said flagpole segments are composed of anodized aluminum tubing.

9. A telescoping flagpole according to claim 7 wherein:

(A) said tubular flagpole segments are approximately six feet in length,
(B) said locking pins are located approximately six inches above the bottom ends of their respective segments,
(C) said locking holes are located approximately six inches below the top ends of their respective segments, and
(D) said stop rings are located approximately one foot below the top ends of their respective segments, whereby the telescopic segments in extended relation overlap by approximately one foot.

* * * * *

UNITED STATES PATENT AND TRADEMARK OFFICE

CERTIFICATE OF CORRECTION

PATENT NO. : 4,918,896

DATED : April 24, 1990

INVENTOR(S) : HAROLD WIESE

It is certified that error appears in the above-identified patent and that said Letters Patent is hereby corrected as shown below:

ON TITLE PAGE:

Abstract, line 2, "of" should be --- or ---.

Col. 1, line 58, after "FIG. 1" insert --- is ---.

Col. 6, line 52, "closure" should be --- close ---.

Signed and Sealed this

Twenty-first Day of July, 1992

*Attest:*

DOUGLAS B. COMER

*Attesting Officer*

*Acting Commissioner of Patents and Trademarks*